US007946337B2

(12) United States Patent
Birbara et al.

(10) Patent No.: US 7,946,337 B2
(45) Date of Patent: May 24, 2011

(54) HEAT EXCHANGER WITH VIBRATOR TO REMOVE ACCUMULATED SOLIDS

(75) Inventors: Philip J. Birbara, West Hartford, CT (US); Arthur K. Colling, Monson, MA (US)

(73) Assignee: Hamilton Sundstrand Corporation, Windsor Locks, CT (US)

( * ) Notice: Subject to any disclaimer, the term of this patent is extended or adjusted under 35 U.S.C. 154(b) by 922 days.

(21) Appl. No.: 11/833,318

(22) Filed: Aug. 3, 2007

(65) Prior Publication Data

US 2009/0032222 A1 Feb. 5, 2009

(51) Int. Cl.
*F28D 11/06* (2006.01)

(52) U.S. Cl. ..... 165/84

(58) Field of Classification Search ..... 165/84
See application file for complete search history.

(56) References Cited

U.S. PATENT DOCUMENTS

| | | | | |
|---|---|---|---|---|
| 2,716,708 | A | | 8/1955 | Bradfield |
| 2,987,068 | A | | 6/1961 | Branson |
| 3,068,829 | A | | 12/1962 | Nuissl |
| 3,240,963 | A | | 3/1966 | Sasaki |
| 3,295,596 | A | | 1/1967 | Ostrofsky et al. |
| 3,389,974 | A | * | 6/1968 | Barattini et al. ..... 23/295 R |
| 3,640,295 | A | | 2/1972 | Peterson |
| 3,789,617 | A | * | 2/1974 | Rannow ..... 165/84 |
| 4,120,699 | A | | 10/1978 | Kennedy, Jr. et al. |
| 4,244,749 | A | | 1/1981 | Sachs et al. |
| 4,372,787 | A | | 2/1983 | Fields et al. |
| 4,750,547 | A | * | 6/1988 | Sakamoto ..... 165/84 |
| 4,893,588 | A | * | 1/1990 | Jekerle et al. ..... 122/379 |
| 5,061,455 | A | | 10/1991 | Brose et al. |
| 5,289,838 | A | | 3/1994 | Odell |
| 5,689,968 | A | * | 11/1997 | Frustaci et al. ..... 62/259.3 |
| 5,876,488 | A | | 3/1999 | Birbara et al. |
| 6,142,151 | A | | 11/2000 | Dean |
| 6,364,938 | B1 | | 4/2002 | Birbara et al. |
| 6,709,483 | B1 | | 3/2004 | Hodgson, Jr. |

FOREIGN PATENT DOCUMENTS

| | | | |
|---|---|---|---|
| JP | 58-156194 | * | 9/1983 |

* cited by examiner

*Primary Examiner* — Teresa J Walberg
(74) *Attorney, Agent, or Firm* — Carlson, Gaskey & Olds

(57) ABSTRACT

A ultrasonic transducer is associated with a heat exchanger and is operable to vibrate a tube associated with the heat exchanger to break up accumulated solids which may have formed on an outer periphery of the tube. A gas flow passes over the tube to remove the pulverized solids.

11 Claims, 1 Drawing Sheet

HEAT EXCHANGER WITH VIBRATOR TO REMOVE ACCUMULATED SOLIDS

BACKGROUND OF THE INVENTION

This application relates to a heat exchanger, which operates to cryogenically cool a gas flow, such as air, and wherein an ultrasonic vibrator is associated with the heat exchanger to cause the breakup of accumulated solids which have been separated from the gas flow.

Heat exchangers to cryogenically cool a gas flow are known for various reasons. In one application, air may be cryogenically cooled.

In another application, air being processed for use in an enclosed space, such as a spacecraft or spacesuit, must be processed. It is known to use alternate sieve beds to absorb carbon dioxide and water from the airflow in one sieve bed, and at the same time recycle the sieve material through a desorb process in an alternate sieve bed.

These applications require somewhat large space, and are unduly complex.

It is known to associate an ultrasonic transducer with a heat exchanger for cleaning the heat exchanger. However, in general, these systems have used the ultrasonic transducer as a separate tool periodically brought in to clean the heat exchanger surfaces.

SUMMARY OF THE INVENTION

In a disclosed embodiment of this invention, a gas flow is cooled at a heat exchanger. An ultrasonic vibrator vibrates the heat exchanger to break up accumulated solids which have been removed from the gas flow. A working fluid passes over the heat exchanger while the vibration is occurring to remove the broken up solids. In one disclosed embodiment, the gas flow may be air, and cryogenic cooling can remove $CO_2$ and water from the air flow. The buildup of accumulated $CO_2$ and water can greatly diminish the heat transfer effect, and by breaking up the accumulations the heat transfer characteristics are maintained.

In another disclosed embodiment, a pair of heat exchangers is associated with valves such that an air flow is passed over a first cooling heat exchanger in a "removal" step, while an alternate flow of purge gas passes over the second heat exchanger. $CO_2$ and water freeze out of the airflow and accumulate on the heat exchanger. The heat exchanger being purged is subjected to ultrasonic vibrations such that accumulated $CO_2$ and water solids are broken away from the heat exchanger, and removed by the purge gas.

In this manner, carbon dioxide and water can be removed from an airflow to very low levels, such that the air flow can be used as air in an enclosed space, such as an aircraft or a space suit.

These and other features of the present invention can be best understood from the following specification and drawings, the following of which is a brief description.

DETAILED DESCRIPTION OF THE PREFERRED EMBODIMENT

Figure 1:
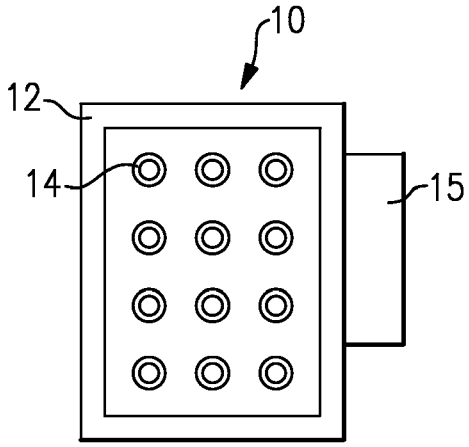
FIG. 1 schematically shows a heat exchanger.

FIG. 1 schematically shows a heat exchanger 10 having an outer housing 12 and a plurality of tubes 14. Air passes between the housing and the tubes and a sub-cooled refrigerant passes through the tubes 14. The refrigerant cools the gas flow. In disclosed embodiments, the refrigerant cryogenically cools the gas flow, but other cooling temperatures which "freeze" components from a gas flow come within the scope of this invention.

A ultrasonic transducer 15 is attached to the housing, and either continuously or periodically vibrates the housing. While many different transducers can be used, a 20 khz vibrating cleaner available as a Brandon Ultrasonic Cleaner, may be utilized.

Figure 2A:
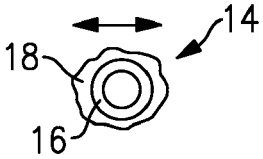
FIG. 2A shows a first heat exchanger tube with accumulated solids.

As shown in FIG. 2A, accumulated solids 18 can build up on an outer surface 16 of the tubes 14. As an example, $CO_2$ and water can freeze out of the air flowing over the tubes 14.

Figure 2B:
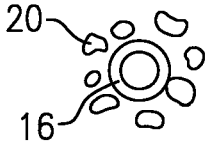
FIG. 2B shows broken up or pulverized solids after vibration has been applied.

When subject to ultrasonic vibration, as shown in FIG. 2B, the solids pulverize or otherwise breakup at 20. Gas flowing over the tubes such as the air to be cooled, can then remove the pulverized solids. In one application, the gas flowing over the tubes 14 may be air to be cryogenically cooled. When air is cryogenically cooled, $CO_2$ and water freeze out of the air, and can form the solids such as shown at 18 in FIG. 2A. By continuously vibrating the heat exchanger 10, the solids are pulverized, and will flow with the airflow heading to a downstream use. The vibration can also occur periodically. In this manner, the cryogenic cooling of the air can occur quite efficiently. Testing of this application shows that the vibration removes substantially all of the solids.

Figure 3:
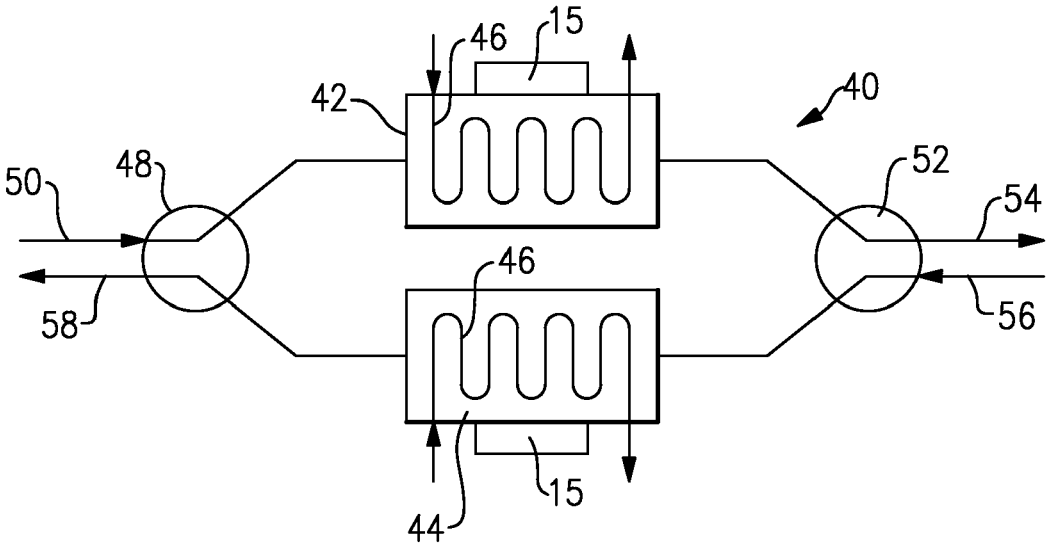
FIG. 3 shows one application for the inventive system.

FIG. 3 shows a system 40 which utilizes this ultrasonic vibration to process a gas flow. As shown, a first heat exchanger 42 and a second heat exchanger 44 each include tubing 46. Tubing 46 each communicate with a refrigerant system such that they cryogenically cool gas flowing over them within the heat exchangers 42 and 44. A valve 48 alternately routes air from a source 50 through one of the heat exchangers and through a second valve 52 to an outlet 54. Outlet 54 may head into an enclosed air usage, such as a spacecraft or space suit.

On the other hand, a source of purge gas, which could be nitrogen, passes through the valve 52, across the heat exchanger 44 which is not receiving the air, and back through the valve 48 to a downstream use 58 such as being delivered outside of the environment. Other valving systems to alternate the gas flows may be used.

Now, air which is to be delivered into the use 54 passes over the heat exchanger 42. The air is cryogenically cooled, and carbon dioxide and water are removed from the airflow as buildup on the tube 46. At the same time, the other heat exchanger 44 is subject to ultrasonic vibration, and the previously accumulated $CO_2$ and water on its heat exchanger 46 is pulverized, and carried away by the purge gas 56. After a period of time, the valves 48 and 52 are reversed, and the heat exchanger 42 will move into a purge mode, while the heat exchanger moves into a $CO_2$ and water removal mode. A control controls the vibrators 15 to run on the heat exchanger in the purge mode and not run vibrator on the heat exchanger removing $CO_2$ and water.

By utilizing this basic convention to assist in removing carbon dioxide and water, air to be supplied into an enclosed space can be properly treated to remove carbon dioxide and water to acceptable levels with a very unique and efficient system.

Although an embodiment of this invention has been disclosed, a worker of ordinary skill in this art would recognize that certain modifications would come within the scope of this invention. For that reason, the following claims should be studied to determine the true scope and content of this invention.

What is claimed is:

1. A heat exchanger comprising:

a plurality of heat exchanger tubes for receiving a cooling fluid;

a space around said plurality of heat exchanger tubes for receiving a gas to be cooled; and an ultrasonic device for vibrating at least a portion of the heat exchanger to remove built up accumulation on said plurality of heat exchanger tubes, said ultrasonic device being operable to vibrate said plurality of heat exchanger tubes while a working gas is flowing over said plurality of heat exchanger tubes, and said space being defined by a housing surrounding said plurality of said heat exchanger tubes, with said ultrasonic device mounted upon said housing, for cleaning said plurality of heat exchanger tubes; and a first working gas is passed over the plurality of heat exchanger tubes to be cooled, and a second working gas is passed over the plurality of heat exchanger tubes while the ultrasonic transducer is vibrating the plurality of heat exchanger tubes to remove pulverized solids removed from the first working gas.

2. The heat exchanger set forth in claim 1, wherein the working gas is air to be cooled, and said ultrasonic device operates as the air continues to pass over said plurality of heat exchanger tubes.

3. The heat exchanger as set forth in claim 1, wherein the first working gas is air.

4. A system for supplying an air flow into an enclosed space comprising:

a pair of heat exchangers, each of said heat exchangers having at least one heat exchanger tube for receiving a cooling tube;

valving for selectively delivering an airflow over a first of said pair of heat exchangers, while a purge gas flows over a second pair of heat exchangers; and an ultrasonic device for vibrating at least one tube of the second heat exchanger as the purge gas flows over the at least one tube to remove solids which have been previously built up on said at least one tube of said second heat exchanger.

5. The system as set forth in claim 4, wherein the valving alternates the airflow and purge gas flow over the first and second heat exchangers.

6. The system as set forth in claim 4, wherein the first and second heat exchangers each have a fixed ultrasonic device.

7. The system as set forth in claim 4, wherein the enclosed space is one of a spaceship and a space suit.

8. The system as set forth in claim 4, wherein there are a plurality of said heat exchanger tubes in each of said first and second heat exchangers, and a housing surrounding said plurality of heat exchanger tubes in each of said first and second heat exchangers, with an ultrasonic device mounted on each of said housings.

9. A method of operating a pair of heat exchangers comprising the steps of:

passing a cooling fluid through a heat exchanger tube in each of a first and second heat exchanger;

passing a first gas to be cooled around said tube in said first heat exchanger;

vibrating at least a portion of said tube in said second heat exchanger to remove built up accumulation while a working gas is flowing over said tube; and air being passed over the tube to be cooled in the first heat exchanger, while the working gas is passed over the tube while vibrating to remove pulverized solids in the second heat exchanger.

10. The method as set forth in claim 9, wherein the first gas is air.

11. The method as set forth in claim 9, wherein a housing is positioned to surround the tubes for each of first and second heat exchangers, with said housings being vibrated to vibrate said portion of said tube.

* * * * *